US006869033B2

(12) United States Patent
Ricco et al.

(10) Patent No.: US 6,869,033 B2
(45) Date of Patent: Mar. 22, 2005

(54) SYSTEM FOR ASSEMBLING AN INTERNAL COMBUSTION ENGINE FUEL INJECTOR

(75) Inventors: Mario Ricco, Casamassima (IT); Adriano Gorgoglione, Modugno (IT)

(73) Assignee: C.R.F. Societa Consortile per Azioni, Turin (IT)

( * ) Notice: Subject to any disclaimer, the term of this patent is extended or adjusted under 35 U.S.C. 154(b) by 325 days.

(21) Appl. No.: 10/034,630

(22) Filed: Dec. 28, 2001

(65) Prior Publication Data

US 2002/0092932 A1 Jul. 18, 2002

(30) Foreign Application Priority Data

Dec. 29, 2000 (IT) ..... TO2000A1229

(51) Int. Cl.[7] ..... B05B 1/30

(52) U.S. Cl. ..... 239/585.1; 239/585.4; 239/585.5; 239/585.3; 239/533.3; 239/600

(58) Field of Search ..... 239/585.1, 585.2, 239/585.3, 585.4, 585.5, 533.2, 533.3, 533.9, 533.16, 600, 88–92, 95; 251/129.15, 129.21

(56) References Cited

U.S. PATENT DOCUMENTS 5,277,398 A 1/1994 Cahanciuc et al. .... 251/129.15
5,335,863 A * 8/1994 DeGrace ..... 239/575
5,544,816 A * 8/1996 Nally et al. ..... 239/585.5
5,551,400 A * 9/1996 Rice et al. ..... 123/470
5,560,549 A 10/1996 Ricco et al. ..... 239/533.8
5,934,567 A * 8/1999 Fly ..... 239/408
6,045,116 A * 4/2000 Willke et al. ..... 251/129.21
6,053,149 A * 4/2000 Lorraine ..... 123/470

FOREIGN PATENT DOCUMENTS

| | | |
|---|---|---|
| DE | 3607811 | 9/1987 |
| GB | 2338275 | 12/1999 |
| WO | 9857061 | 12/1998 |
| WO | 9904161 | 1/1999 |

OTHER PUBLICATIONS

English Abstract DE 3607811 Dated Sep. 10, 1987.

* cited by examiner

*Primary Examiner*—Davis Hwu
(74) *Attorney, Agent, or Firm*—Ladas & Parry LLP

(57) ABSTRACT

The injector has a hollow body supporting an ordinary injection nozzle and a metering valve for metering the fuel to be injected; and a support defined by a sleeve and by an end wall. The sleeve houses an electromagnet controlling the metering valve, and is fitted to the hollow body. For which purpose, there is provided a leaf spring having a ring-shaped portion engaging the end wall of the support; and a number of elastic blades, each terminating with a hook-shaped appendix which engages a corresponding retaining element on the hollow body.

10 Claims, 2 Drawing Sheets

SYSTEM FOR ASSEMBLING AN INTERNAL COMBUSTION ENGINE FUEL INJECTOR

The present invention relates to a system for assembling an internal combustion engine fuel injector.

BACKGROUND OF THE INVENTION

Injectors normally comprise a hollow body fitted with an injection nozzle and a fuel metering valve; and a support fitted to the hollow body and housing an electromagnet controlling the valve. More specifically, the support comprises a sleeve inserted in fluidtight manner inside a cylindrical cavity in the hollow body; and an end wall having a discharge conduit and on which an edge of the sleeve is bent to lock the electromagnet.

In known technology, the sleeve is fitted to the hollow body by means of a threaded ring nut screwed to an external thread on the hollow body. Such a system has various drawbacks. In particular, the hollow body must have a cylindrical portion on which to form the thread, so that the ring nut is larger in diameter than the threaded portion, and the injector therefore relatively wide. Moreover, the thread and ring nut call for additional machining, which makes the injector fairly expensive to produce; and the two threads may retain machining debris or other solid particles which, when assembling the injector, get into the conduits, thus impairing operation of the injector.

SUMMARY OF THE INVENTION

It is an object of the invention to provide a system for assembling a fuel injector, which is extremely straightforward, requires no tools, and at the same time reduces the cost of the injector and eliminates the drawbacks typically associated with known assembly systems.

According to the present invention, there is provided an assembly system for assembling an internal combustion engine fuel injector comprising a hollow body supporting an injection nozzle; said hollow body housing a metering valve for metering the fuel to be injected by said nozzle, and comprising a support housing an electromagnet controlling said metering valve; and said support being fitted to said hollow body; characterized in that said support is connected removably to said hollow body by click-on means.

More specifically, the click-on means comprise a leaf spring having a number of elastic blades, each having a hook-shaped appendix which hooks on to a corresponding shoulder of the hollow body. The support comprises a sleeve, which is inserted in fluidtight manner inside a cylindrical cavity in the hollow body, and an end wall having a discharge conduit of the metering valve; and the leaf spring having a ring-shaped portion engaging the end wall and having an opening in which the discharge conduit is inserted.

BRIEF DESCRIPTION OF THE DRAWINGS

A preferred, non-limiting embodiment of the invention will be described by way of example with reference to the accompanying drawings, in which.

DETAILED DESCRIPTION OF THE INVENTION

Figure 1:
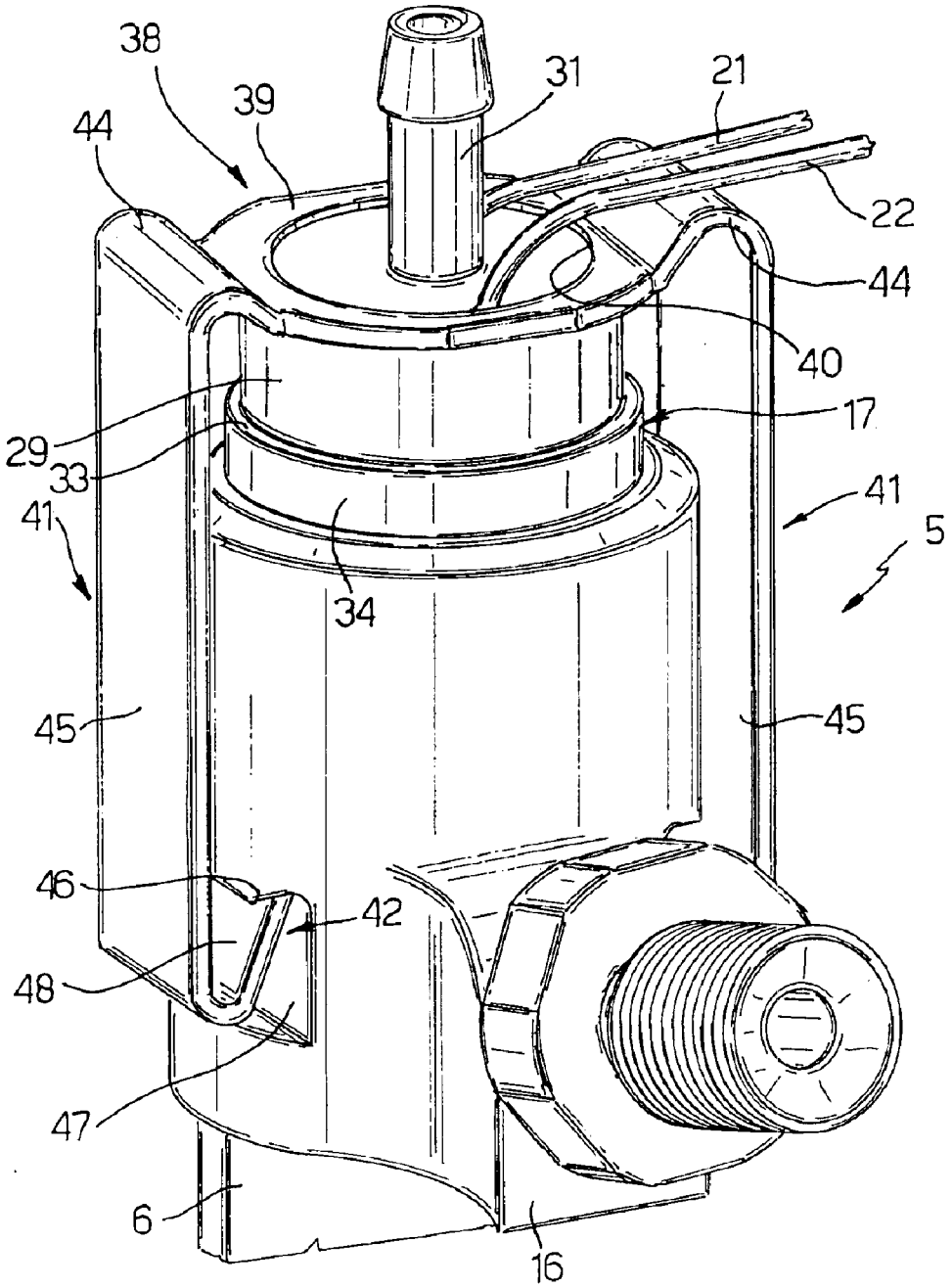
FIG. 1 shows a partial view in perspective of an injector featuring the assembly system according to the invention.
Figure 2:
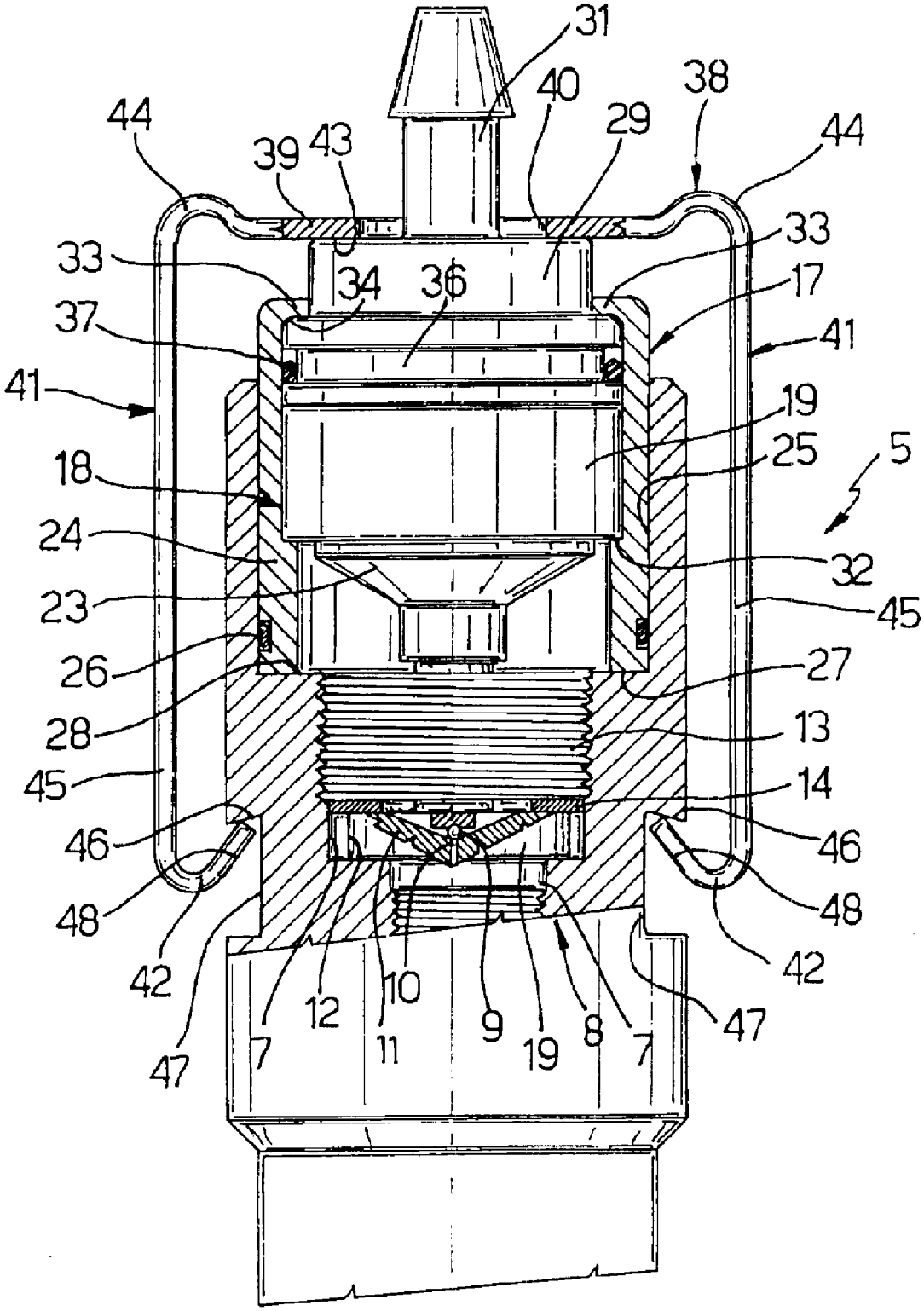
FIG. 2 shows a vertical, partly sectioned view of the FIG. 1 injector.

With reference to FIG. 1, number 5 indicates as a whole a fuel injector for an internal combustion engine, e.g. a diesel engine. Injector 5 comprises a substantially cylindrical hollow body 6 fitted at one end (not shown in FIG. 1) with an ordinary injection nozzle normally closed by a pin cooperating with a control rod. Hollow body 6 has a substantially cylindrical cavity 7 (FIG. 2) housing a metering valve 8 for metering the fuel to be injected by the nozzle and which controls the control rod in known manner.

Metering valve 8 comprises a ball shutter 9 cooperating with a conduit 10 of a valve body 11, which is fixed against a shoulder 12 of cavity 7 by an inner threaded ring nut 13 with the interposition of a calibrated washer 14. Hollow body 6 also comprises an appendix 16 (FIG. 1) having a hole and which is connected to the high-pressure fuel supply conduit and communicates with conduit 10 and the injection nozzle.

Injector 5 also comprises a support 17 for housing an electromagnet 18 controlling metering valve 8. Electromagnet 18 comprises a cylindrical magnetic core 19, and is excited by two electric conductors 21 and 22 to activate a substantially disk-shaped armature 23 controlling shutter 9 in known manner. Support 17 substantially comprises a sleeve 24 which is inserted inside a cylindrical cavity 25 of hollow body 6. Cavity 25 is coaxial with cavity 7, and is larger in diameter so as to form another shoulder 28 of hollow body 6. The lateral wall of sleeve 24 has a seal 26 for sealing the wall of cavity 25, and an edge 27 of sleeve 24 rests on shoulder 28 of hollow body 6.

Support 17 also comprises an end wall 29 integral with a discharge conduit 31 by which fuel is discharged in known manner when valve 8 is opened. Core 19 of electromagnet 18 is locked against a shoulder 32 of sleeve 24 by cold-bending another edge 33 of sleeve 24 on to a shoulder 34 of end wall 29; and another seal 37 is inserted inside a groove 36 in the lateral surface of end wall 29 to seal sleeve 24 and prevent fuel leakage from cavities 7 and 25.

According to the invention, to assemble injector 5, support 17 is connected removably to hollow body 6 by click-on means preferably defined by a single leaf spring indicated as a whole by 38. Leaf spring 38 substantially comprises a flat portion 39 having an opening 40 and a number of elastic blades 41, each of which has a hook-shaped appendix 42 on the end.

More specifically, portion 39 is ring-shaped, and opening 40 circular; ring-shaped portion 39 engages an outer surface 43 of end wall 29, from which discharge conduit 31 extends; opening 40 of ring-shaped portion 39 houses discharge conduit 31; and elastic blades 41 are integral with ring-shaped portion 39 and are located radially in angularly equidistant positions.

Elastic blades 41 are preferably two in number and located diametrically opposite on ring-shaped portion 39. Each elastic blade 41 comprises a curved portion 44 and a straight portion 45. Curved portion 44 is so shaped as to keep the respective straight portion 45 substantially perpendicular to ring-shaped portion 39, so that the various straight portions are parallel to one another and to the axis of opening 40; and curved portion 44 is in the form of a bend projecting from the surface of portion 39 in the opposite direction to straight portion 45.

Each hook-shaped appendix 42 is defined by an end of respective blade 41 bent inwards to form an inclined portion 48, and clicks on to a corresponding retaining element of hollow body 6. More specifically, each retaining element is defined by a circumferential shoulder 46 on hollow body 6, in turn defined by a corresponding outer depression 47 on hollow body 6.

Each shoulder 46 has a surface forming an underside recess with the outer surface of hollow body 6, so as to retain the end of hook-shaped appendix 42; and leaf spring 38 is die-cut from elastic sheet metal and so sized that the two hook-shaped appendixes 42 engage the surfaces of the two shoulders 46 with sufficient force exerted by elastic blades 41 to keep edge 27 of sleeve 24 resting firmly on shoulder 28 of hollow body 6.

To assemble injector 5, valve body 11 is first inserted inside cavity 7 of hollow body 6—into which the nozzle pin and control rod have already been fitted—and is fixed inside hollow body 6 by ring nut 13 which locks valve body 11 against shoulder 12 of cavity 7 via the interposition of washer 14. Electromagnet 18 and end wall 29 with seal 37 are then inserted inside sleeve 24, and edge 33 is bent on to shoulder 34 of end wall 29 to secure electromagnet 18 firmly between shoulder 32 and edge 33 of sleeve 24.

Opening 40 of ring-shaped portion 39 of leaf spring 38 is then placed about conduit 31, and ring-shaped portion 39 is placed on end wall 29; both shutter 9 and the stem of armature 23 are then inserted inside the usual cavity in ring nut 13; and, finally, sleeve 24, together with seal 37, is inserted inside larger-diameter cavity 25. At this point, hook-shaped appendixes 42 of leaf spring 38 engage the outer surface of hollow body 6, so that respective inclined portions 48 flex elastic blades 41 outwards.

When edge 27 of sleeve 24 contacts shoulder 28 of hollow body 6, the ends of hook-shaped appendixes 42 are positioned adjacent to the edges of respective shoulders 46; and by exerting additional manual pressure on curved portions 44 of elastic blades 41, the two hook-shaped appendixes 42 click inside the two depressions 47 in hollow body 6 and are retained by the two underside recess shoulders 46 to keep elastic blades 41 taut and so ensure edge 27 is kept resting firmly on shoulder 28.

Leaf spring 38 may, obviously, be fitted to hollow body 6 after inserting sleeve 24 inside cavity 25, so that, when ring-shaped portion 39 is placed on surface 43 of end wall 29, the two hook-shaped appendixes 42 are positioned adjacent to the edges of shoulders 46, as in the previous case. Alternatively, one of blades 41 may be flexed outwards to click the hook-shaped appendix 42 of the other blade 41 first into respective depression 47, and only the curved portion 44 of the flexed blade 41 be pressed manually to click the respective hook-shaped appendix 42 into the respective depression 47.

Injector 5 is disassembled by simply exerting manual pressure on one of curved portions 44 to flex the corresponding blade 41 outwards and release the respective hook-shaped appendix 42 from the corresponding shoulder 46, or, obviously, by manually parting both blades 41 at the same time.

The advantages, as compared with known systems, of the injector assembly system according to the invention will be clear from the foregoing description In particular, the outer ring nut and the outer surface of the hollow body no longer need threading; machining debris is prevented from getting inside injector 5; and assembly is greatly simplified by sleeve 24 being assembled and disassembled with no tools required.

Clearly, changes may be made to the assembly system as described herein without, however, departing from the scope of the accompanying claims. For example, leaf spring 38 may have a different number of elastic blades, e.g. three, spaced 120° apart; ring-shaped portion 39 may be polygonal, and opening 40 other than circular; and, to simplify engagement of the outer surface of hollow body 6 by inclined portions 48 of appendixes 42, hollow body 6 may have a caulked edge.

What is claimed is:

1. In an assembly system for assembling an internal combustion engine fuel injector, the improvements comprising:

a hollow body (6) supporting an injection nozzle, said hollow body (6) housing a metering valve (8) for metering fuel to be injected by said nozzle;

a support (17) housing an electromagnet (18) controlling said metering valve (8), said support (17) being fitted to said hollow body (6); and click-on means (38) for removably connecting said support (17) to said hollow body (6), characterized in that said click-on means comprise a leaf spring (38) on one of said hollow body (6) or support (17), said leaf spring (38) comprising at least one hook-shaped appendix (42) which clicks on to a corresponding retaining element (46) on the other of said hallow body (6) or support (17).

2. An assembly system as claimed in claim 1, wherein said hollow body (6) comprises a cylindrical cavity (25), and said support (17) comprises a sleeve (24) which is inserted in fluidtight manner inside said cylindrical cavity (25); characterized in that said leaf spring (38) comprises a number of elastic blades (41), each having a hook-shaped appendix (42); said hollow body (6) comprising a corresponding number of shoulders (46) on to which said hook-shaped appendixes (42) click.

3. An assembly system as claimed in claim 2, characterized in that each of said elastic blades (41) comprises a straight portion (45) parallel to the axis of said cylindrical cavity (25); each of said shoulders (46) being located at a depression (47) in the lateral wall of said hollow body (6).

4. An assembly system as claimed in claim 3, characterized in that said elastic blades (41) are two in number and located diametrically opposite with respect to said hollow body (6).

5. An assembly system as claimed in claim 3, wherein said support (17) also comprises an end wall (29) having a fuel discharge conduit (31) of said metering valve (8); characterized in that said leaf spring (38) comprises a central flat portion (39) lying in a plane perpendicular to said straight portions (45) of said elastic blades (41); said flat portion (39) engaging said end wall (29).

6. An assembly system as claimed in claim 5, characterized in that said flat portion has an opening (40) in which said discharge conduit (31) is inserted.

7. An assembly system as claimed in claim 6, characterized in that said flat portion (39) is ring-shaped, and said opening (40) is circular; said elastic blades (41) being formed in one piece with and located radially with respect to said flat portion (39).

8. An assembly system as claimed in claim 7, characterized in that each of said shoulders (46) is defined by an underside recess surface in the outer surface of said hollow body (6).

9. An assembly system as claimed in claim 6, characterized in that the straight portion (45) of each of said elastic blades (41) is connected to said flat portion (39) by a curved portion (44) forming a bend projecting from said flat portion (39) in the opposite direction to said straight portion (45); said curved portion (44) being engaged manually to click on said hook-shaped appendix.

10. An assembly system us claimed in claim 3, characterized in that each of said hook-shaped appendixes (42) comprises an inclined portion (48) which engages the outer surface of said hollow body (6) to flex outwards the corresponding elastic blade (41) of said leaf spring (38).

* * * * *